US005566471A

United States Patent [19]

Hirano

[11] Patent Number: 5,566,471

[45] Date of Patent: Oct. 22, 1996

[54] ELECTROMOTIVE CURTAIN FOR DRYING CLOTHES

[76] Inventor: Yoshitaka Hirano, 207 gou, 106 banti, 1 chrome, Hirabari, Japan

[21] Appl. No.: 239,891

[22] Filed: May 9, 1994

[30] Foreign Application Priority Data

Dec. 24, 1993 [JP] Japan ..... 5-077024 U

[51] Int. Cl.[6] ..... F26B 19/00; F26B 25/06; F26B 9/00; E05F 15/20

[52] U.S. Cl. ..... 34/201; 34/611; 34/618; 160/5

[58] Field of Search ..... 34/91, 165, 167, 34/175, 184, 201, 225, 618, 239, 240, 667; 160/5, 29, 331, DIG. 17, DIG.19

[56] References Cited

U.S. PATENT DOCUMENTS

| | | | |
|---|---|---|---|
| 1,135,267 | 4/1915 | Dieckmann | 34/201 |
| 1,590,143 | 6/1926 | Williams | 34/201 |
| 3,294,151 | 12/1966 | Hartley et al. | 160/5 |
| 3,762,067 | 10/1973 | Whittaker et al. | 34/201 |
| 3,952,947 | 4/1976 | Saunders | 126/583 |
| 3,965,348 | 6/1976 | Anetseder, Sr. et al. | 160/5 |
| 5,026,109 | 6/1991 | Merlot, Jr. | 296/105 |
| 5,080,423 | 1/1992 | Merlot et al. | 296/105 |
| 5,332,021 | 5/1992 | Todd et al. | 160/33 |

FOREIGN PATENT DOCUMENTS

| | | | |
|---|---|---|---|
| 0561096 | 3/1992 | European Pat. Off. | 160/5 |

*Primary Examiner*—John M. Sollecito
*Assistant Examiner*—Steve Gravini

[57] ABSTRACT

An electromotive curtain machine for drying clothes using a rain sensor, a sunshine sensor, and a wind sensor which will send existing rain, sun, or wind conditions to a central processing unit so as to control a curtain driving unit. The curtain driving unit will close curtains to protect drying clothes from undesirable weather elements. When more desirable weather elements exist, the curtain driving unit will open curtains so that the clothes drying may continue. Curtain rails are used on the electromotive curtain machine capable of withstanding strong winds. The electromotive curtain machine is suitable for a narrow apartment veranda or a house where the space is limited.

3 Claims, 2 Drawing Sheets

ELECTROMOTIVE CURTAIN FOR DRYING CLOTHES

BACKGROUND OF THE INVENTION

Japanese patent application no. JP-A63-73997 for automatic machine for drying clothes is disclosed in Japan.

This former technology is good. However, it requires a container for the washing. So, we can not use it on the narrow veranda. We require big container for washing many clothes. However, we can not set such a container in the narrow Japanese apartment or house.

Japanese patent application JP-A4-8399 is disclosed in Japan . This is to take the washed clothes into the room. However, using this former technology, the wet washing changes the atomosphere of the room, for example, temperature, humidity, and so on.

Furthermore, the room is not comfortable to live in, when we use this former technology. Because, the room is occupied with the machine.

The formentioned technologies are not suitable for narrow Japanese apartment or houses and hangers and washing clothes may drop when using the former machine.

Japanese utility model application no. JP-U5-018490 is disclosed in Japan. This former technology is a hand-motive curtain for drying clothes with a fine view. This is for the protection from the sun and for screening the washing clothes from people outside.

Japanese utility model application no. JP-U5-52 is disclosed in Japan. This former technology is for the protection of outside garden plant from wind, rain and hail.

SUMMARY OF THE INVENTION

My invention is a system for drying clothes. This works, when it rains and we are not home. This is suitable for narrow Japanese apartment or houses. The basis of my invention is to protect the drying clothes from rain, using the umbrella made of an electromotive curtain.

Using the signals from the rain sensor 1, photo sensor 5, and the wind sensor 6, central processing unit 4 judges and gives the instruction to the curtain driving unit 2 and opens or closes the curtain 3.

When it rains in our absence, rain sensor 1 detects the rain and the central processing unit 4 sends the curtain driving unit 2 the signal of "Close the curtain" and the curtain 3 closes.

When it stops raining or the sun comes out, these are detected with the rain sensor 1 or photo sensor 5, and the central processing unit 4 sends the curtain driving unit 2 the signal of "Open the curtain" and the curtain 3 opens. Even if the weather is fine, if a strong wind rises, the wind sensor 6 detects it, and the central processing unit 4 sends the curtain driving unit 2 the signal of "Close the curtain" and the curtain 3 is closed. So, we can prevent the case that the washing is blown off.

When the wind subsides,the wind sensor 6 detects it, and the central processing unit 4 sends the curtain driving unit 2 the signal of "Open the curtain" and the curtain 3 opens.

The explanation of the reference Marks

Figure 1:
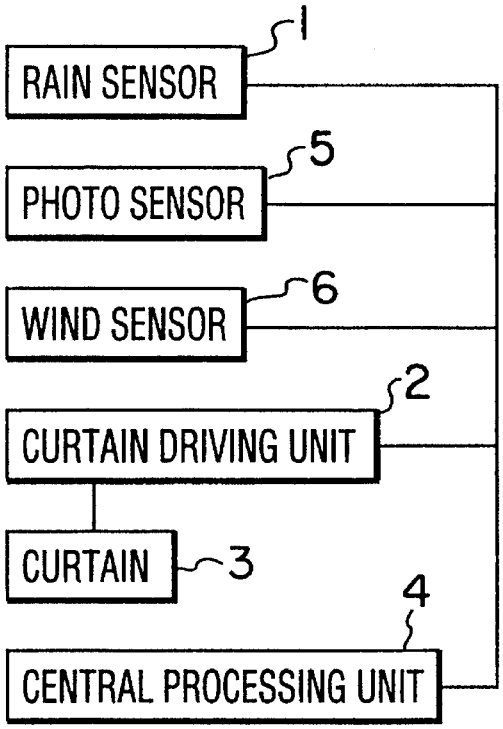
FIG. 1 the block chart of this invention

1: Rain sensor
2: Curtain driving unit
3: Curtain
4: Central processing unit
5: Photo sensor
6: Wind sensor
7: Curtain rail
8: Curtain rail of the upper side
9: Curtain rail of the lower side
10: Veranda
11: A roof of the veranda
12: Frame for drying clothes
13: Screen board among the neighboring room
14: Hangers and washing
15: Support of the frame for the drying clothes
20: Pole

DETAILED DESCRIPTION OF THE INVENTION

The transparent nylon curtain can be used for the curtain 3. The curtain driving unit 2 is made from the motor and so on.

Besides the case that the family is absent, we had better use this system when the family is at home. When we use the heater of the room in winter, or when we use the air cooler in summer, even if it becomes rain, we do not have to take the washing into the room. Because this system protects the washing from the rain. So, we can conserve the temperature of the room, because we can keep the door to the veranda closed. we can save money on heating or cooling.

If we open the door of the veranda by closing the curtain, we can partially the air of the room from the air of the outside. Thus, we can take in the washing without the loss of the air conditioning.

In my invention, we can close the door of the veranda, so, there is no fear of security. Japanese patent application no. JP-A4-8399 does not have this merit.

We can dry the curtain 3 which gets wet, if we close the curtain 3 when the weather is fine. When the curtain 3 drys, we can open the curtain 3. We can extinguish the normal operation mode of this invention from the above operation mode for the dry of the curtain.

That is to say, we can use these two modes automatically with the central processing unit 4 by software.

If we use the technology for the bathroom curtain of Japanese patent application no. JP-A3-184512, we can suppress the mold on the curtain 3.

If we apply the technology for the cut of the infrared ray of Japanese patent application no. JP-A60-207620, and if we close the curtain 3 automatically with photo sensor 5 and the central processing unit 4, when the sunshine becomes strong in summer, we can suppress the sunshine into the room and so save money on cooling. We can use the above operatin mode when we do not dry the washing. We can extinguish the normal operation mode of this invention from the above operation mode for the cut of sunshine into the room. That is to say, we can use these two modes automatically with the central processing unit 4 by software.

We can apply the above operation mode to the case that the washing needs the dry without the sunshine, for example, Japanese clothes (Kimono).

Figure 2:
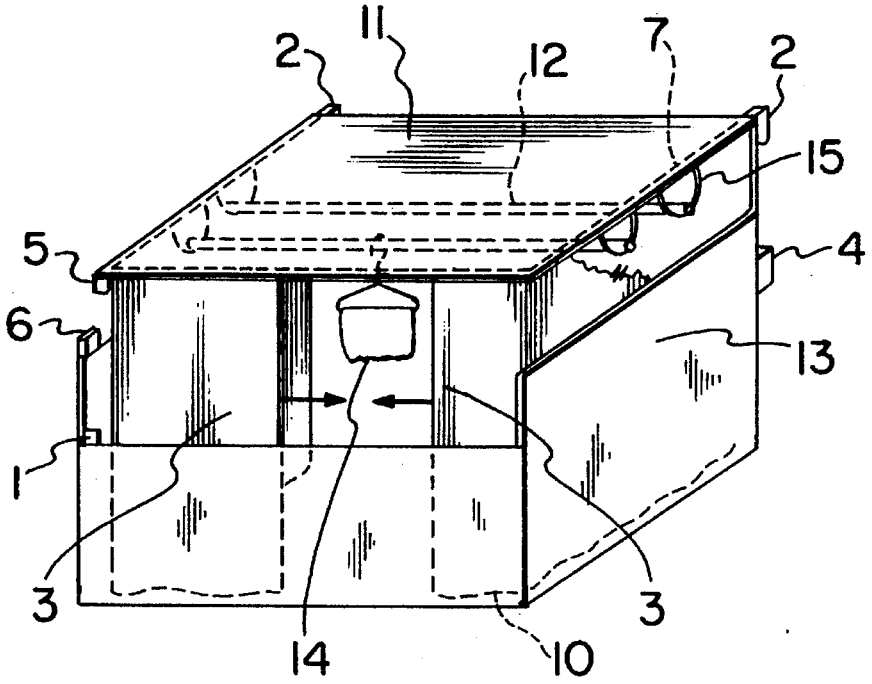
FIG. 2 An example of a possible use

FIG. 1 shows the constitution of this invention. FIG. 2 shows the example of enforcement of this invention. This case means that there is a roof 11 on the veranda 10 in the apartment house. A roof 11 on the veranda means a veranda of the upper floor. In this case, we can set the curtain rail 7 on the roof 11 of the veranda and we can use two sheets curtain, (see FIG. 2) or we can use one sheet curtain, (see FIG. 4).

In both cases, we can protect the washing 14 in the veranda from the rain.

When we set a frame 12 for drying clothes on the garden, there is not a "roof". We can use the curtain as in FIG. 3. This electro-motive curtain goes up and down.

Ordinarilly, we set a curtain rail 7 on the upper side as in FIG. 2. However, if we set a curtain rail on the lower and upper side as in FIG. 4, the curtain can be fixed, so, againt the strong wind, this system will be suitable. Especially, this will be advantageous in the case the room is on the corner of the buiding and there is a strong side wind.

We do not have to set the wind sensor 6 in a place where there is no anxiety about the wind. In the case there is a screen board 13 among the neighboring room, there will be only a small side wind, so we have only to set the curtain rail only on the upper side as in FIG. 2.

Figure 4:
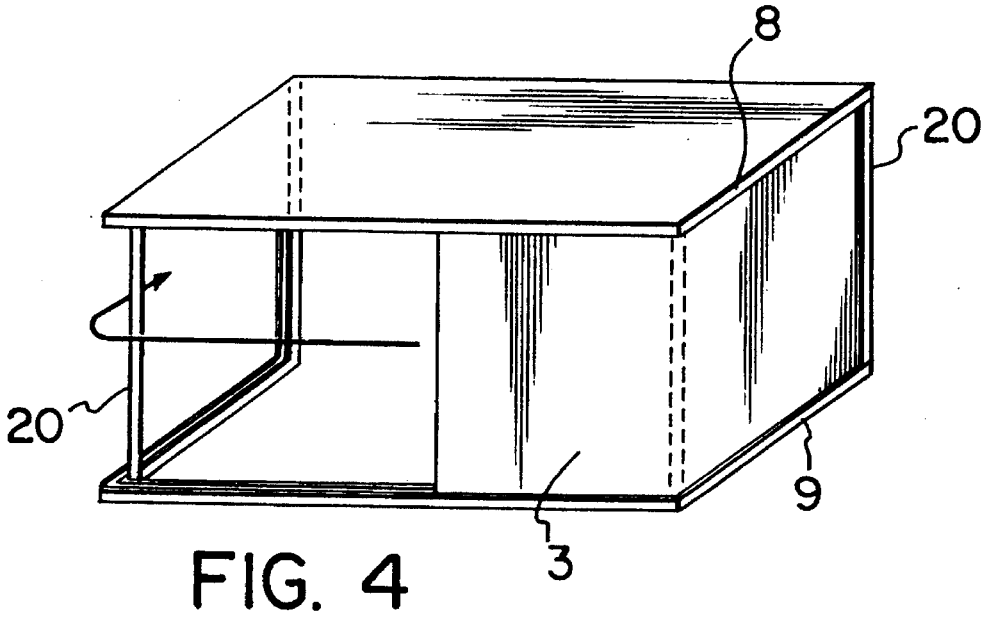
FIG. 4 the same as above

One sheet curtain system as in FIG. 4 has a simple curtain driving unit rather than two sheet curtain system as in FIG. 2. Therefore a one sheet curtain system may be cheaper than a two sheet curtain system. Former machines for drying clothes move the hangers and the washing 14. However, this invention do not move hangers and the washing 14. Essentially, this invention has the advantage that the hangers and the washing 14 do not drop among the tranfer. In other word, the possibility that the washing drops and becomes dirty is very small.

Figure 3:
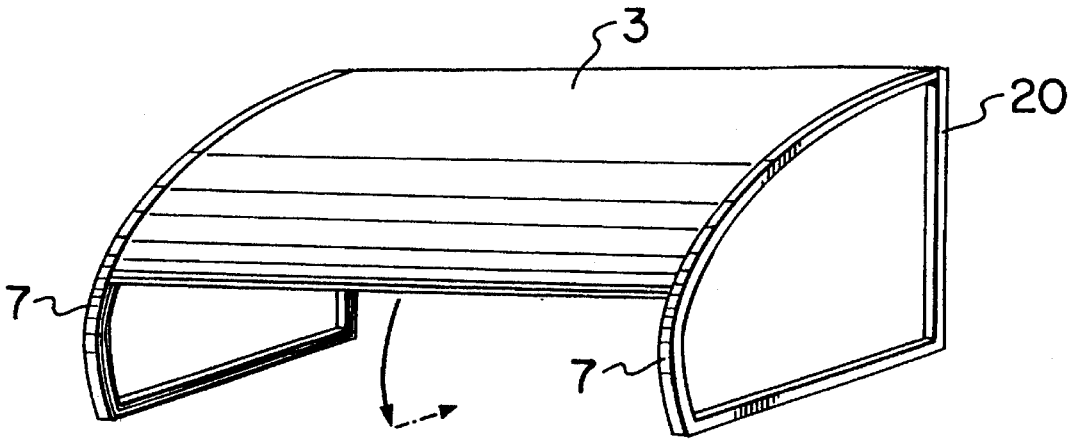
FIG. 3 the same as above

We can protect the washing from the rain that comes from the upper and front side, using the curtain system that moves up and down as in FIG. 3. Along with this, if we use the curtain system that moves horizontally, as in FIG. 2 or FIG. 4, we can protect the rain that comes from the right and the left side.

If the curtain of FIG. 3 goes half way around and the curtain covers the lower side of the washing, the washing will be caught by the curtain and becomes less dirty, even if there is no curtain that moves horizontally, the side wind is strong and the washing drops.

We can protect the door of the veranda in the case of flying objects as in a typhoon, if we use the curtain system as in FIG. 4.

We can protect the privacy of the room if we use the laminated curtain.

This invention will be cheaper than previous ones because containers and equipments for taking the washing into the room are not necessary.

We need an automatic system for drying clothes that is suitable for a narrow Japanese apartment or houses. If we use the curtain to seal the area as in FIG. 4, we can use this invention for the prevention of noise.

What is claimed is:

1. Electromotive curtain machine for drying clothes comprising a rain sensor for detecting rain, photo sensor for detecting sunshine, curtain driving unit which opens or closes a curtain and central processing unit which gives a signal of opening or closing to said curtain driving unit according to a signal of said rain sensor and a signal of said photo sensor.

2. Electromotive curtain machine of claim 1 wherein a signal of wind sensor is also used by said central processing unit.

3. Electromotive curtain machine of claim 2 wherein curtain rails are used on upper side and lower side of veranda against strong wind.

* * * * *